United States Patent [19]

Zeltner et al.

[11] Patent Number: 5,075,918

[45] Date of Patent: Dec. 31, 1991

[54] COMBINATION CLEANING TOWEL AND CARRYING CASE WITH CONSTRUCTION METHOD THEREFORE

[75] Inventors: Barry Zeltner, Englewood; Richard E. Butler, Lakewood, both of Colo.

[73] Assignee: Recreative Technologies Corporation, Wheat Ridge, Colo.

[21] Appl. No.: 471,219

[22] Filed: Jan. 26, 1990

[51] Int. Cl.[5] ..... A47L 13/16

[52] U.S. Cl. ..... 15/210 R; 15/208; 15/114; 383/38

[58] Field of Search ..... 15/209 R, 208, 210 R, 15/145; 150/160; 206/315.4; 383/38, 40

[56] References Cited

U.S. PATENT DOCUMENTS

| | | | |
|---|---|---|---|
| 2,047,745 | 7/1936 | Poppe | 383/38 |
| 3,977,452 | 8/1976 | Wright | 383/38 X |
| 4,418,733 | 12/1983 | Kallman | 383/38 X |
| 4,516,616 | 5/1985 | Fesler | 15/209 R X |
| 4,634,618 | 1/1987 | Greer et al. | 383/38 X |
| 4,771,502 | 9/1988 | Trimble | 15/209 R |
| 4,779,655 | 10/1988 | Olson | 383/40 X |
| 4,953,603 | 9/1990 | Holden | 15/209 R X |

*Primary Examiner*—Chris K. Moore

*Attorney, Agent, or Firm*—Timothy J. Martin

[57] ABSTRACT

The invention consists of a combination cleaning device and carrying case able to be releasably secured to a golf bag. The body of the device is made from a towel folded and stitched to form two back-to-back pockets on the upper portion of the body, with the lower portions hanging freely thereform, with an optional cleaning brush fastened on the lower front thereof. The pockets may be closed at their tops by hook and loop fasteners.

20 Claims, 5 Drawing Sheets

COMBINATION CLEANING TOWEL AND CARRYING CASE WITH CONSTRUCTION METHOD THEREFORE

FIELD OF INVENTION

The present invention broadly relates to golf accessory items, but, more specifically to the field of combination cleaning devices and carrying cases which may be employed by golfers to clean their implements and equipment and to carry both personal items and golf accessories. With greater particularity, the present invention is directed to a combination apparatus providing carrying compartments for items and which provides both a brush member and a towel portion for cleaning golf equipment and accessories. As such, the present invention is an extension of the technology described in co-pending U.S. patent application Ser. No. 232,306, now U.S. Pat. No. 4,912,800, issued Apr. 3, 1990, and assigned to the assignee of the present application.

BACKGROUND OF THE INVENTION

As noted in the above referenced co-pending application, the game of golf has grown to be one of the worlds great past times and enjoys popularity as a recreational sport throughout the world. During play, the golf clubs and accessories of the golfer are transported across the playing course, from hole to hole. A golfer often experiences situations wherein various items of his/her equipment and implements become soiled. For example, the faces of the golf clubs can become covered with dirt or mud, a golf ball may become dirty or a golfers feet and shoes may become caked with undesirable dirt and mud. Thus, as noted in the above referenced co-pending application, it is desirable to provide an effective cleaning device for golf equipment and accessories.

In addition to this problem of cleaning equipment and accessories, the present invention addresses a further need commonly experienced by those who enjoy the game of golf. This problem arises from the need to store and transport various personal items as well as the golf accessories so that they may be conveniently available for the golfer during play. Examples of such items which are commonly used during the play of golf include, without limitation, extra golf balls, golf tees, ball markers, score cards, pencils and the like. Personal items which must be retained include again for example without limitation, keys, chains, wallets, watches, sunglasses, rings and the like.

Typically, a golfer desires to store such accessories and personal items neither in the pockets of his/her clothing nor in the storage compartments provided on a typical golf bag. In the first instance, a golfer seeks to avoid the distractions and awkwardness of carrying accessories and personal items in his/her pockets since the same can adversely affect the concentration of the golfer while swinging a golf club. In the second instance, storage of accessories and items in the compartments of a golf bag is inconvenient since the items can become jumbled together resulting in disorganization and even damage to the items. Thus, under many circumstances, the use of the normal storage compartments of the golf bag have been found to be quite inconvenient.

Accordingly, there is a need for an auxillary apparatus in the form of a carrying case which may conveniently store and transport various commonly used golf accessories and to conveniently and safely store limited numbers of personal items. There is a particular need for such carrying case that not only provides convenient storage compartments but also combines the useful functions of a cleaning device to clean golf equipment and accessories. The present invention, therefore, is directed to these needs.

SUMMARY OF THE INVENTION

It is an object of the present invention to provide a new and useful carrying case in which a golfer may store and transport personal items, golf accessories and the like and which carrying case may be readily and releasably secured to a golf bag for use by the golfer.

Another object of the present invention is to provide a combination carrying case and cleaning apparatus which can not only store and transport various items but also be used to clean golf equipment and accessories.

A further object of the present invention is to provide a combination cleaning apparatus and carrying case which neatly organizes often used golf accessories and separates the same from personal items while at the same time maintaining such items in a manner convenient for retrieval and use.

A still further object of the present invention is to provide a combination cleaning apparatus and carrying case that is relatively inexpensive to produce yet which is attractive in appearance and durable in use.

Yet another object of the present invention is to provide a fabrication method for the combination cleaning device and carrying case having the objects and advantages discussed above.

According to the present invention, then, a combination cleaning towel and carrying case apparatus is provided which may be releasably secured to a golf bag for use by a golfer to store and transport personal items and golf accessories. This combination apparatus broadly includes a towel body having an upper portion, a lower portion and a front and a back. A releasable fastener is mounted on an upper portion of the towel body in order to releasably secure the towel body to a golf bag. A first pocket structure is formed on the upper portion of the towel body on the front thereof so that the first pocket structure has an interior and an upwardly oriented first pocket opening. A second pocket structure is formed on the upper portion of the towel body on the back thereof with the second pocket structure also having an interior and an upwardly oriented second pocket opening. In this apparatus, it is preferred that the first and second pocket structures be positioned in back-to-back relation to one another so that a lower portion of the towel body extends downwardly therefrom to form a cleaning towel adapted for use in cleaning golfing accessories and equipment. Further, it is desirable that a brush member be secured to the towel body and that this brush member be releasably securable to a lower portion of the towel body so that it is spaced from the fastening structure thereby to be more readily available for cleaning golf equipment and accessories. To this end also, it is desired that the brush member have a back plate and a plurality of bristles extending outwardly from the back plate on one side thereof and a first member of a complementary pair of mating hook and loop fastening elements secured to the other side of the back plate. The other of the pair of complementary mating hook and loop fastening elements is then secured to the towel body.

In it exemplary form, the present invention has a plurality of sleeve structures formed in one of the pocket structures with the sleeve structures sized to retain elongated items such as pencils, golf tees and the like. This pocket structure is preferably open and can receive one or two golf balls conveniently for use. The sleeve structures is preferably located in the interior of the selected pocket structure and may be formed by a common strip of material attached along a plurality spaced apart sleeve stitching lines. This strip may be formed of an elastic material to resiliently retain the elongated items. Further, it preferred that the other pocket structure have a releasable closing elements, again such as complementary hook and loop fasteners. This pocket may be sealed to contain personal items such as wallets, rings, sunglasses, watches and the like.

In the preferred form, the combination cleaning and carrying case apparatus is formed as a rectangular towel body having three layers in the form of a front panel, an intermediate panel and a back panel which overlay one another to have a common bottom edge, pair of common opposite side edges and a generally common top edge. These panels are stitched together in a U-shaped pattern so that a pair of stitching seams may be formed along respective common side edges on opposite sides of the towel body and a transverse seam formed across the panels to join the panels together thus forming a pair of pocket structures. Preferably, the rectangular towel body is formed of a single rectangular piece having first and second pairs of opposite peripheral edges with this rectangular piece being tri-folded along a pair of parallel fold lines. Preferably, the pair of fold lines are parallel to side edges of the rectangular piece which side edges are the shorter of the rectangular sides.

From the foregoing, it should be appreciated that the preferred method according to the present invention includes a first step of providing a rectangular towel piece which may be folded about first and second fold lines parallel to first and second side edges with these fold lines being equidistantly spaced respectively from the first and second side edges and from each other so that the towel piece, when folded, forms three overlaying panels comprising a front panel, an intermediate panel and a back panel. this folding step thus defines a tri-fold towel body having a towel body top edge, a towel body bottom edge and a pair of towel body side edges. After folding, the tri-fold towel body is stitched longitudinally along each of the towel body side edges from a respective starting point proximate the towel body top edge to respective stopping point intermediate between the towel body top and bottom edges. The tri-fold towel body is then stitched transversely between the stopping points to form a front pocket structure between the front and intermediate panels and a back pocket structure between the back and intermediate panels. A brush member may be secured to one of the front, intermediate and back panels and this step of securing the brush member may include the step of releasably securing the brush member by means of complementary hook and loop fasteners. In the preferred method, various bands of hook and loop fasteners may be attached adjacent the top edge of the rectangular piece, and a strip of material may be also placed parallel to and proximate the top edge and stitched to form sleeves. When the rectangular piece is folded, the bands of hook and loop fasteners from a closure for one of the pocket structures while the sleeve stitched strip forms sleeves interiorily of the other pocket structure so as to receive elongated items. To this end also, it is preferred that the sleeve structure be formed on a flap portion of the rectangular piece created by slitting the rectangular piece along one or more of the fold lines to create a flap that is then folded to form a revers that is attached to the rectangular towel body. When assembled, the tri-fold towel body then provides a pair of pocket structures with an open pocket having a pocket opening that is spaced from the top edge of the towel body and with a second pocket having a pocket opening with releasable closures that is co-extensive with the towel body top edge.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a combination cleaning towel and carrying case apparatus which is releasably attachable to a golf bag so that a golfer may carry such apparatus with him/her during the play of the game of golf. To this end, the present invention is directed to apparatus that will not only allow the golfer to clean golfing equipment and accessories but also which will allow the golfer additional convenient storage of pockets for various golf accessories and personal items. To this end, it should be understood that personal items as used herein can refer to any type of personal items normally carried in a golfer's pockets, such as change, keys, rings, watches, wallets, sunglasses and the like. Further, golf accessory items as referred to herein are those golf accessory items normally carried in a persons pockets such as golf score cards, pencils, tees, ball markers, golf balls and the like. Of these, elongated items may readily refer to such items as pencils and golf tees.

Figure 1:
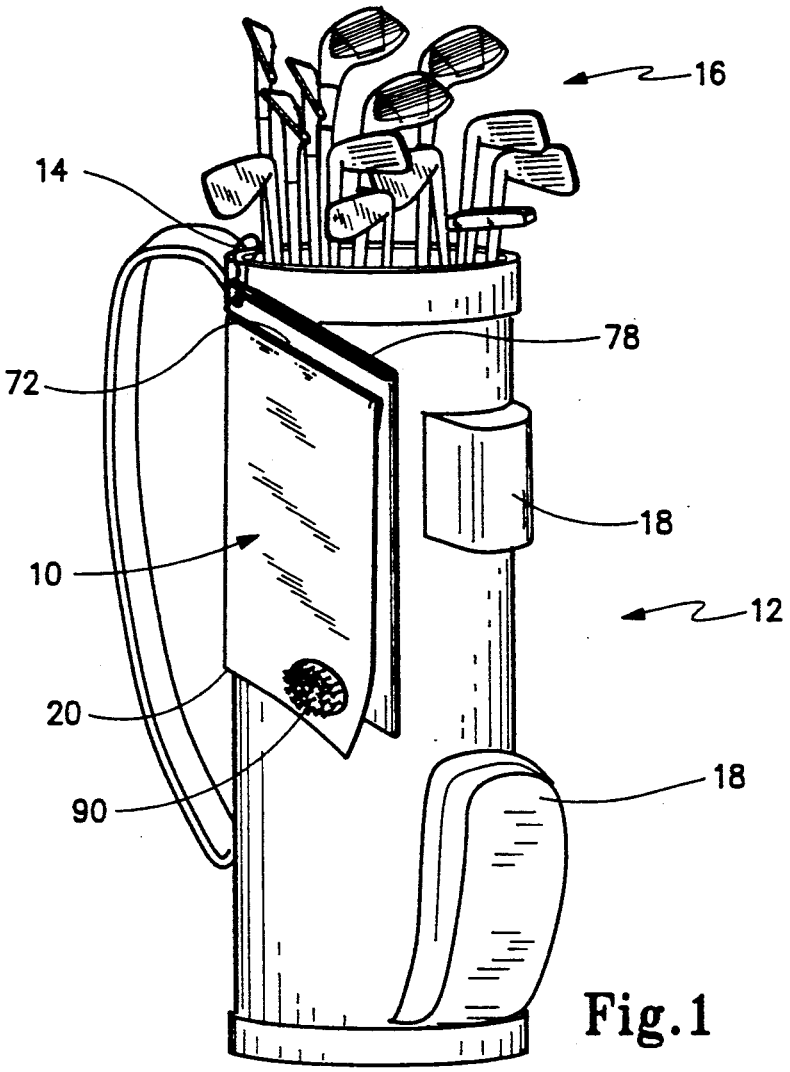
FIG. 1 is a perspective view showing a golf bag having attached thereto the combination cleaning device and carrying case apparatus according to the preferred embodiment of the present invention.
Figure 3:
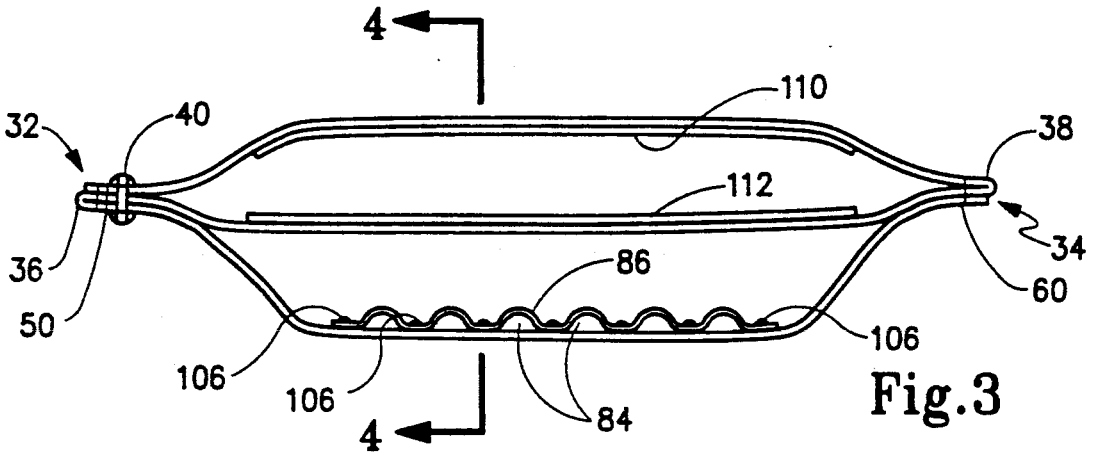
FIG. 3 is a cross-sectional view taken about lines 3—3 of FIG. 2, with the combination cleaning towel and carrying case apparatus shown in an open position.
Figure 2:
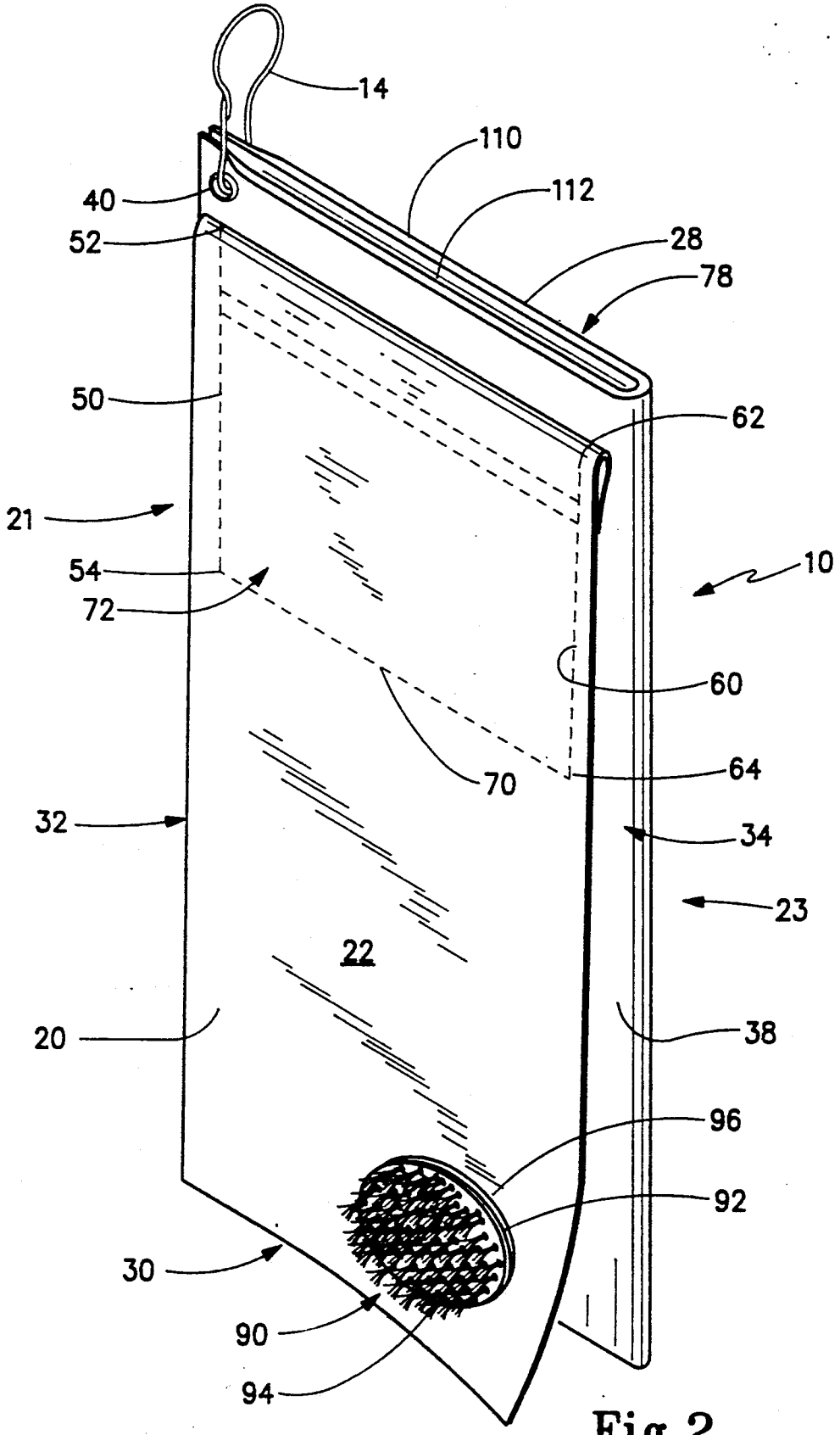
FIG. 2 is a perspective view of the combination cleaning towel and carrying case apparatus according to the present invention.
Figure 4:
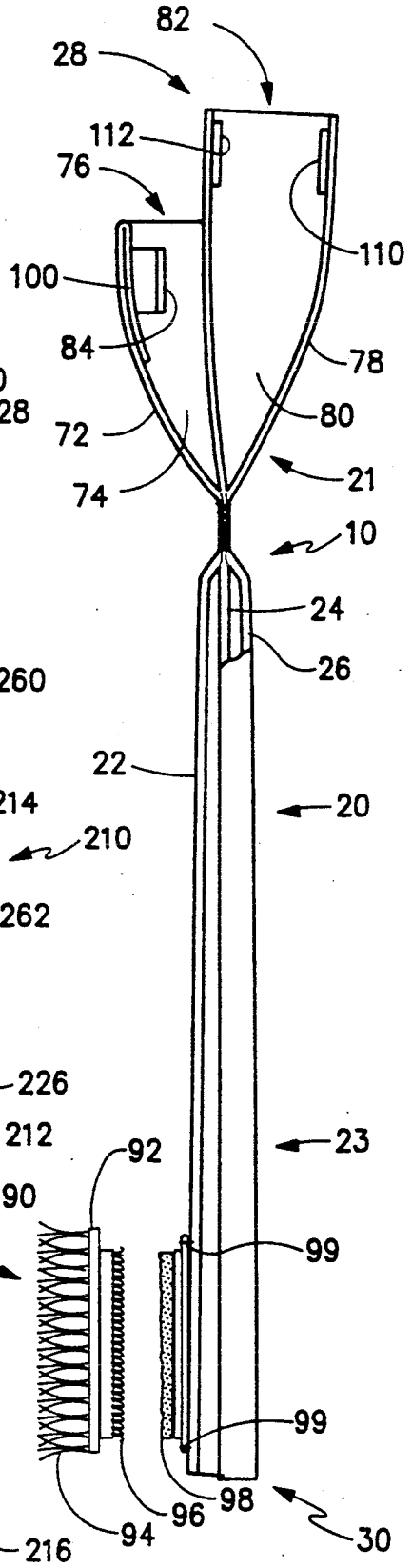
FIG. 4 is a cross-sectional view taken about lines 4—4 of FIG. 3.

The exemplary embodiment of the present invention is best shown in FIGS. 1–4 wherein it should be appreciated that the combination cleaning device and carrying case apparatus 10 broadly includes a towel body 20 upon which a plurality of pocket structures 72 and 78 are formed. More specifically, as is shown in these figures, a combination cleaning device and carrying case apparatus 10 is shown and is attachable to a golf bag 12 by a fastening clip 14 secured at one corner of apparatus 10. Apparatus 10 provides a convenient cleaning device for golfing equipment, such as golf clubs 16 as well as additional storage compartments which are convenient to use and supplements storage compartments 18 shown on golf bag 12. With reference to FIGS. 2–4, it may be sen that apparatus 10 is constructed as a tri-fold towel body 20 having a front panel 22, an intermediate panel 24, and a back panel 26 which overlay one another to have a generally common top edge 28, a common bottom edge 30 and a pair of opposite common side edges 32 and 34. As is described more thoroughly below, towel body 20 is formed of a single piece of towel material so that front panel 22 and intermediate panel 24 are joined at revers 36. Similarly, intermediate panel 24 and back panel 26 are connected at revers 38. A grommet 40 is located at an upper corner of towel body 20 proximate the intersection of top edge 28 and side edge 32, and clip 14 extends through grommet 40 so that clip 14 many be used to attach towel body 20 to a mounting element on golf bag 12.

Panels 22, 24 and 26 are joined together by U-shaped stitching at an upper portion 21 of towel body 20 in order to define a front and back pocket structure for apparatus 10. As is shown in FIg. 2, a first stitching seam 50 extends parallel to and proximate to side edge 32 along a first marginal portion from a first location 52 adjacent top edge 28 to an intermediate location 54 which is located between top edge 28 and bottom edge 30. Similarly, second attachment means in the form of stitching 60 is provided parallel to and proximate side edge 34 and extends along a second marginal portion from a start location 62 proximate top edge 28 to an intermediate location 64 that is between bottom edge 30 and top edge 28. Transverse stitching 70 extends between intermediate locations 54 and 64 in order to secure panels 22, 26 and 28 together at an intermediate location.

Stitching 50, 60 and 70 thus interconnect these panels so that first pocket structure 72 is formed on the front of upper portion 21 of towel body 20 and second pocket structure 78 is formed on the back of upper portion 21 of towel body 20. First pocket structure 72 has an interior 74 terminating in a mouth or upper opening 76. Similarly, second pocket 78 has an interior 80 which has a mouth or upper opening 82 located at edge 28. Thus, the first and second pocket structures 72, 78 are upwardly oriented in order to receive accessory items and personal items. Further, as is seen in FIGS. 3 and 4, first and second pocket structures 72, 78 are in back-to-back relation to one another so that a lower portion 23 of towel body 20 extends downwardly from pocket structures 72 and 78 to form at least one cleaning panel adapted to use in cleaning golf accessories and equipment. To this end, also, and as more thoroughly described below, a brush member 90 is releasably secured to lower portion 23 of towel body 20.

In order to increase the utility of pocket structure 72, it may be seen that a plurality of longitudinal sleeves 84 are formed by a strip of material 86 that is sewn in the interior of pocket structure 72. To this end, a flap portion 100 of front panel 22 forms a revers 102 so that flap portion extends downwardly and interiorily of pocket structure 22 and is secured by means of transverse stitching 104. Strip 86 is secured to flap 100 by means of spaced apart sleeve stitching so that the sleeve structures 84 are defined by regions between adjacent sleeve stitching lines 106. Strip 86 may be formed of any suitable cloth material and, if desired, can be formed by an elastic material so that the sleeve structures 84 were resiliently retaining elongated items such as golf tees and pencils. To this end also, various ones of sleeve structures 84 may have different diametric sizes to accommodate different diameters of elongated items.

To enhance the utility of back pocket structure 78, a pair of complementary fastening means in the form of matable hook and loop fastening strips 110 and 112 are attached in the interior 80 of pocket structure 78 adjacent top edge 28. Fasteners 110 and 112 mate with one another to releasably close and seal opening 82 so that items placed therein may be retained in interior 80.

As noted above, a brush 90 is releasably secured to towel body 20 at lower portion 23. To this end, as is shown in FIG. 4, brush 90 includes a back plate 92 from which a plurality of bristles 94 extend outwardly on one side thereof. A first member of a complementary hook and loop fastener pair is secured to back plate 92 opposite bristles 94. To this end, first member 96 is preferably filaform elements which may mate with a second member of the complementary hook and loop fasteners in the form of a fabricate loop pad 98 secured to towel body 20 by stitching 99. Thus, brush 90 may be removed from towel body 20 and used to clean golf equipment or accessories after which brush 90 may be refastened to towel body 20; for transportation and storage.

Figure 5A:
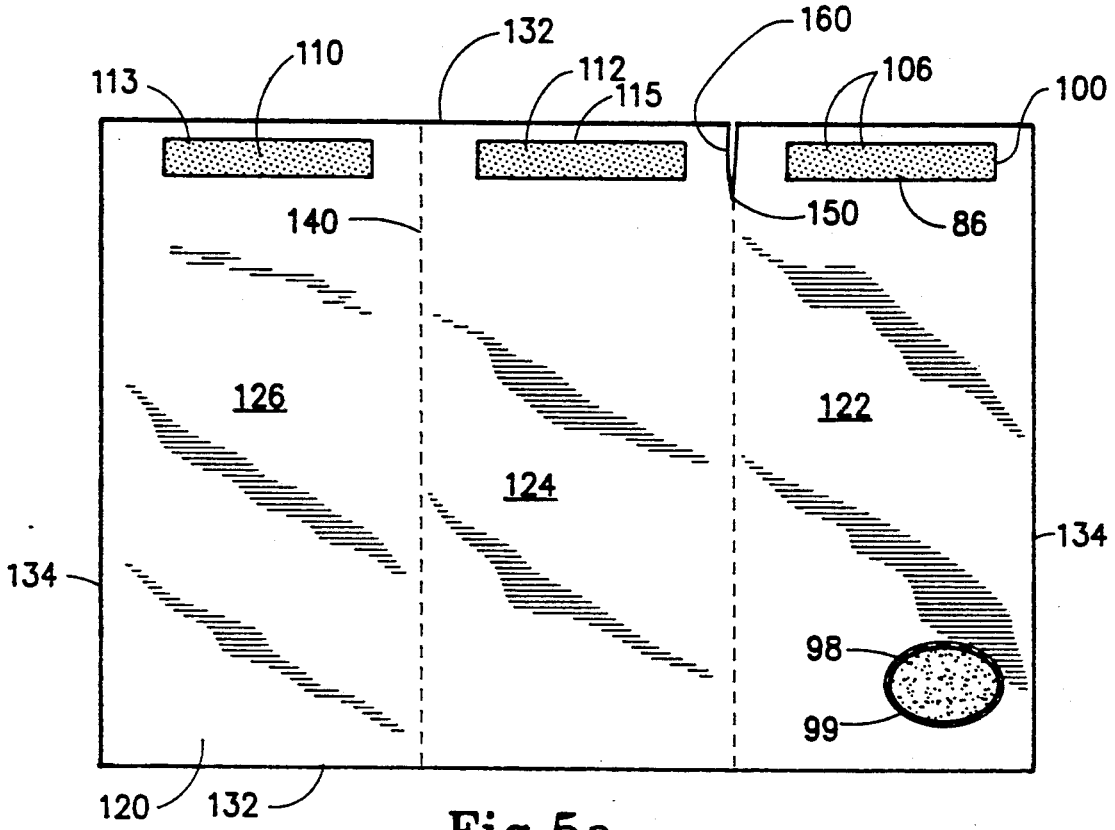
FIGS. 5*a*–5*e* show the consecutive construction steps of the combination cleaning towel and carrying case apparatus according to the construction method for the present invention.
Figure 5B:
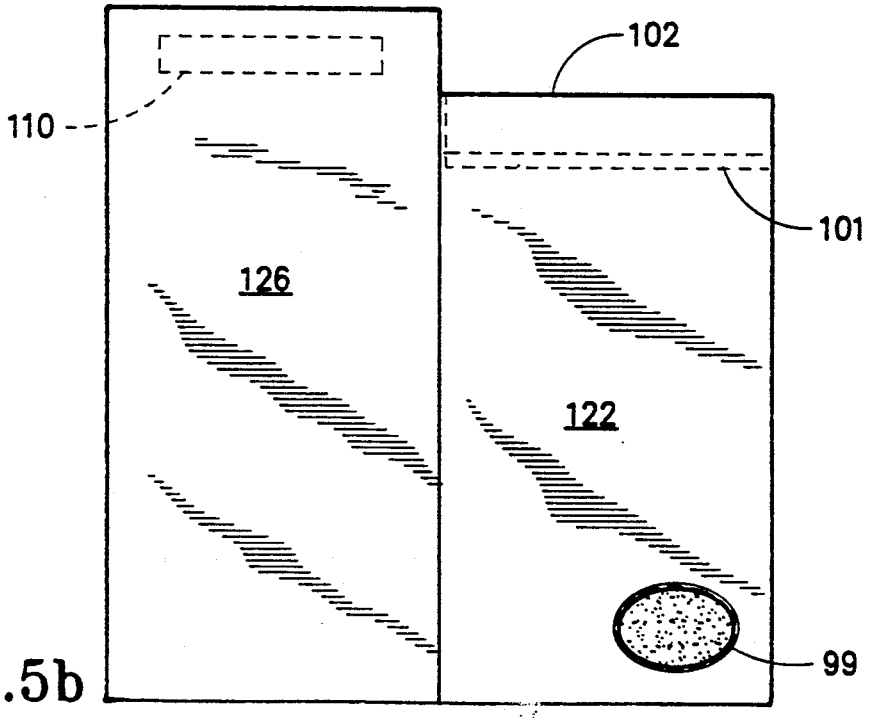
Figure 5C:
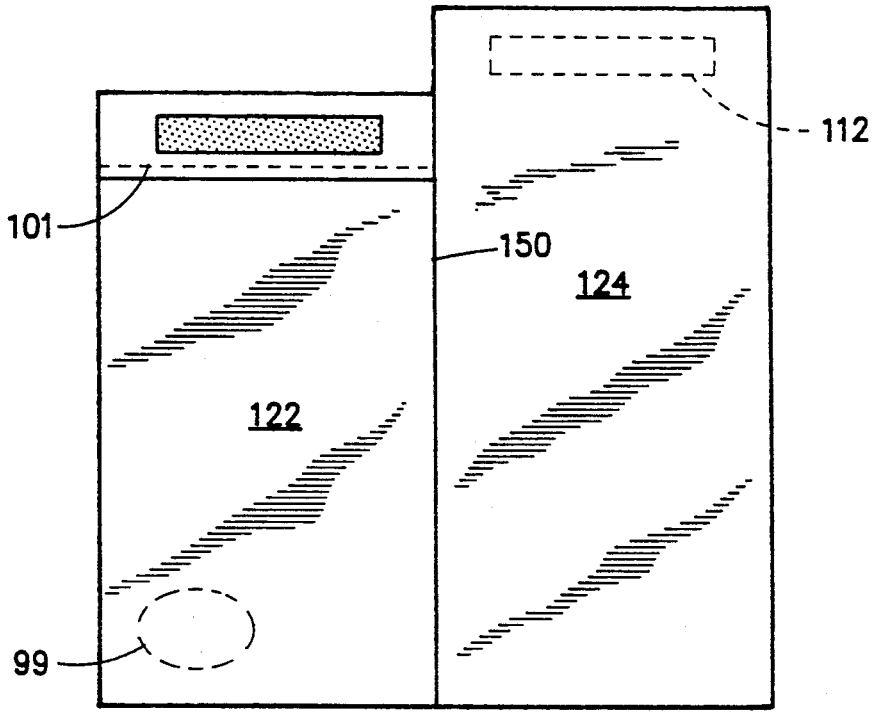
Figure 5D:
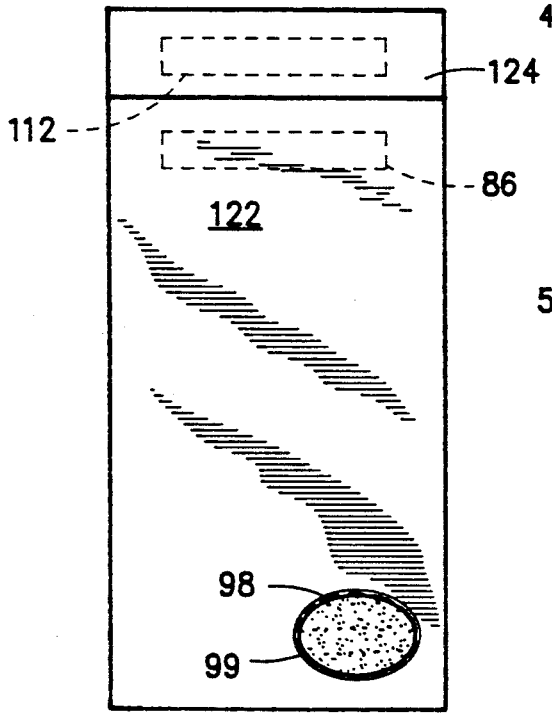
Figure 5E:
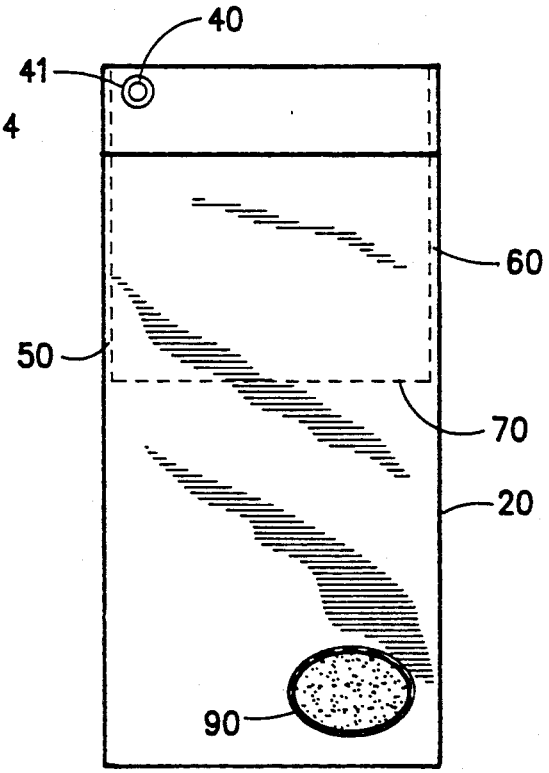

The construction method of apparatus 10 may now be more readily understood and appreciated with reference to FIGS. 5*a*–5*e*. Commencing with FIG. 5(*a*), it may be seen that towel body 20 may be formed of a single rectangular piece 120 of towel material which has a first pair of opposite peripheral edges 132 and a second pair of opposite peripheral edges 134. Edges 134 are the shorter edges of rectangular panel 120, and, is shown in FIG. 5*a*, rectangular panel 120 may be designated to include a front panel portion 122, a rear panel portion 126, and intermediate panel portion 124. First and second fold lines 140 and 150 are designated. Prior to forming rectangular panel piece 120 into a tri-fold towel body, it is preferred to first attach the mating pair of hook and loop fasteners 110, 112 as bands of material to locations proximate edge 132 and centrally located respectively, on panels 126 and 124. Bands 110 and 112 are respectively attached to panels 126 and 124 by stitching 113 and 115. Similarly, strip 86 is secured to the front of panel 122 by longitudinal sleeve stitching 106 at a location of central of panel 122 and proximate edge 132. A slit 160 is provided to extend from edge 132 longitudinally along fold line 150 so that slit 160 is parallel to side edges 134 in order to form flap 100 upon which sleeve strip 86 is fastened. Finally, fabric loop pad 98 is attached by stitching 99 on a lower portion of panel 122 at the front of rectangular piece 120.

As is shown in FIGS. 5(*b*) and 5(*c*), construction of towel body 20 proceeds by folding panel 126 so that it overlays panel 124 thus mating complementary bands 110 and 112. Flap 110 is folded at revers 102 and sewn to itself by means of transverse stitching 101. After flap 100 is secured and bands 110 and 112 are fastened together, panel 122 may be folded along fold line 150 to the orientation shown in 5(*d*), wherein strip 86 is now located between panel 122 and panel 124. Completion of the assembly is then accomplished by forming stitch lines 50, 60 and 70 in the U-shaped configuration and by mounting grommet 40 corner 41 of towel body 20.

Brush member 90 is secured to pad 98, as described above.

It should be appreciated from the foregoing method of construction, that the formation of towel body of a single piece of material allows for inexpensive fabrication of apparatus 10 by minimizing the number of stitching lines and thus time involved in assembling the apparatus 10. It should be understood, though, that this assembly method has been provided for sake of illustration and that other assembly techniques incorporating the concepts described above are within the scope of this invention.

Figure 6:
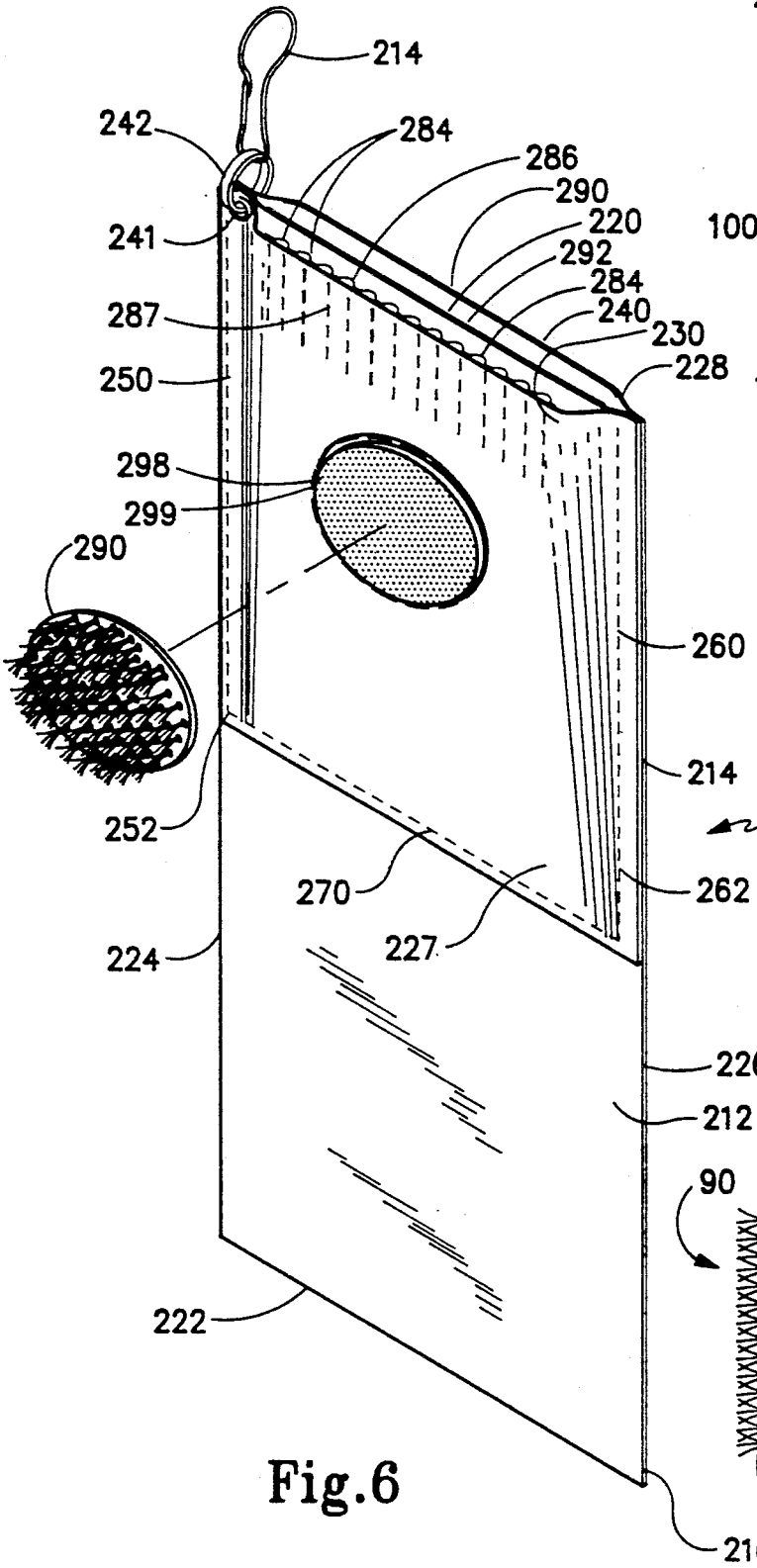
FIG. 6 is a perspective view of an alternate embodiment of the present invention.

As is shown in FIG. 6, an alternate embodiment of a combination cleaning device and carrying case apparatus is shown where an apparatus 210 is formed by a first piece of rectangular towel material 212 having an upper portion 214 and a lower portion 216. Towel panel 212 has a top edge 220, a bottom edge 222, and a pair of side edges 224 and 226. First and second pocket structures 230 and 240 are formed, respectively, on the front and back of panel 212 by a front panel section 226 and a back panel section 228 which are commonly sewn together and to panel 212 by means of a first stitching 250 stitching 250 is adjacent side edge 224 and extends from top edge 220 longitudinal to an intermediate location 252. Similarly, a second stitching 260 extends from top edge 220 proximate and parallel to edge 226 to an intermediate location 262. Transverse stitching 270 extends between intermediate locations 252 and 262 so that stitching lines 250, 260, an 270 are U-shaped to form pocket structures 230 and 240. Pocket structure 240 may be provided with a strip of material 286 sewn by sewing lines 287 at parallel spaced intervals therealong to define sleeve structures 284 similar to those described with respect to sleeves 84 in the preferred embodiment. Likewise, pocket 240 may be provided with mating hook and loop closures 290 and 292 so that pocket 240 may be releasably sealed. A ring 242 extends through a grommet 241 and supports a clip 214 for attachment of apparatus 210 to a golf bag. A pad of looped material 298 is sewn by stitching 299 to a front of apparatus 210 along panel 212 and a brush member 290 identical in construction to brush member 90 may be secured to loop pad 298 by the cooperative engagement of the filaform elements on the back of brush member 290 engaging loop material 298. It may be appreciated, therefore, that the structure shown in FIG. 6 provides a simplified combination golf cleaning device and carrying case that reduces the amount of time necessary in construction and the amount of towel material used in manufacture.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A combination cleaning device and carrying case apparatus adapted to be releasably secured to a golf bag for use by a golfer to store and transport personal items, golf accessories, such as balls, tees, pencils, score cards, and the like, and to clean golf equipment and accessories comprising:

a towel body constructed of at least three panel portions organized to define a first pair and a second pair of facing panel portions, said towel body having an upper portion, a lower portion and a front and a back;

means on the upper portion of said towel body for releasably securing said towel body to said golf bag:

a first pocket structure formed on the upper portion out of the first facing pair of said towel portions, said first pocket structure having an interior and an upwardly oriented first pocket opening;

a second pocket structure formed on the upper portion of said towel body out of the second facing pair of said panel portions, said second pocket structure having an interior and an upwardly oriented second pocket opening; and said first and second pocket structures being positioned in back-to-back relation to one another such that the lower portion of said towel body extends downwardly therefrom and is freely suspended, said towel body being secured on said golf bag to form cleaning panels adapted for use in cleaning golfing accessories.

2. Apparatus according to claim 1 including a brush member secured to said towel body.

3. Apparatus according to claim 2 wherein said brush member is secured to the lower portion of said towel body.

4. Apparatus according to claim 2 including releasable securing means for securing said brush member to said towel body.

5. Apparatus according to claim 4 wherein said brush member has a back plate and a plurality of bristles extending outwardly from said back plate, said releasable securing means including a complementary pair of mating hook and loop fastening elements, one member of said pair being attached to said back plate on a side thereof opposite said bristles and another member of said pair being attached to said towel body.

6. Apparatus according to claim 1 wherein a selected one of said first and second pocket structures includes a plurality of sleeve structures formed thereon and sized to receive and retain elongated items therein.

7. Apparatus according to claim 6 wherein said sleeve structures are located in the interior of the selected one of said first and second pocket structures.

8. Apparatus according to claim 6 wherein said sleeve structures are formed by a common strip of material attached to the selected one of said first and second pocket structures along a plurality a spaced apart sleeve stitching lines whereby said sleeves structure are defined by regions between adjacent sleeve stitching lines.

9. Apparatus according to claim 6 wherein said common strip is constructed of an elastic material whereby said sleeve structures will resiliently retain said elongated items.

10. Apparatus according to claim 1 including closure means for releasably closing one of said first and second pocket structures at the respective one of the first and second pocket opening thereof.

11. A carrying case according to claim 10 wherein said closure means comprises a complimentary pair of mating hook and loop fastening elements attached to said one of said first and second pocket structures on opposite sides of the respective interior thereof.

12. Apparatus according to claim 1 wherein said means for releasably securing includes a grommet element and a clip element mounted through said grommet element, said clip element adapted to releasably engage a mounting structure on said golf bag.

13. A combination cleaning towel and carrying case apparatus adapted to be releasably secured to a golf bag for use by a golfer to store and transport personal items and golf accessories while playing golf and for use to clean golf equipment and accessories, comprising:

a rectangular towel body including a front panel, an intermediate panel and a back panel overlaying one another to have a common top edge portion, a common bottom edge portion and a pair of opposite common side edge portions;

first attachment mean for securing said front, intermediate and back panels together along a first side marginal portion adjacent one of said common side edge portions and second attachment means for securing said front, intermediate and back panels together along a second side marginal portion adjacent another of said common side edge portion, each of said first and second attachment means extending from a start location proximate said common top edge to an intermediate location between said common top and bottom edges;

third attachment means for securing said front, intermediate and back panels together transversely thereacross at said intermediate location whereby a front pocket structure is formed between said front and intermediate panels and a back pocket structure is formed between said back and intermediate panels, said front and back pocket structures having front and back pocket openings, respectively, at said common top edge portion; and means proximate said common top edge portion for releasably securing said towel body to said golf bag.

14. Apparatus according to claim 13 including a brush member secured to said towel body.

15. Apparatus according to claim 13 wherein said front pocket structure has a plurality of sleeve structures formed therein and sized to receive and retain elongated items therein.

16. Apparatus according to claim 15 wherein said sleeve structures are formed by a common strip of material attached to said front pocket structure along a plurality of spaced apart sleeve stitching lines whereby said sleeve structures are defined by regions between adjacent sleeve stitching lines.

17. Apparatus according to claim 16 wherein said common strip is constructed of an elastic material whereby said sleeve structures will resiliently retain said elongated items.

18. Apparatus according to claim 13 including closure means for releasably closing said back pocket opening.

19. Apparatus according to claim 13 wherein said front panel has a top flap portion folded internally of said front pocket structure and secured therein so that said front pocket opening is located below said back pocket opening at said common top portion.

20. Apparatus according to claim 13 wherein said rectangular towel body is formed by a single rectangular piece having first and second pairs of opposite peripheral edges said rectangular piece tri-folded along a pair of fold lines parallel to one another and to a selected pair of said peripheral edges into said front, intermediate back and back panels of said towel body with one peripheral edge of the selected pair overlay with one of said fold lines to define one of the side edges of said towel body and another peripheral edge of the selected pair overlay with another of said fold lines to define another of said side edges of said towel body.

* * * * *